US007987518B2

(12) United States Patent
Calderwood

(10) Patent No.: US 7,987,518 B2
(45) Date of Patent: Aug. 2, 2011

(54) CHILD KNEE PAD

(76) Inventor: Betty Calderwood, Riverside, CA (US)

( * ) Notice: Subject to any disclaimer, the term of this patent is extended or adjusted under 35 U.S.C. 154(b) by 195 days.

(21) Appl. No.: 12/338,120

(22) Filed: Dec. 18, 2008

(65) Prior Publication Data

US 2010/0154094 A1 Jun. 24, 2010

(51) Int. Cl.
*A41D 13/00* (2006.01)

(52) U.S. Cl. ..... 2/24

(58) Field of Classification Search ..... 2/22, 23, 2/24, 62, 79, 227, 69, 80
See application file for complete search history.

(56) References Cited

U.S. PATENT DOCUMENTS 847,240 A * 3/1907 Chamberlain ..... 446/26
5,285,585 A * 2/1994 Baker ..... 36/112
5,579,552 A * 12/1996 Henry ..... 5/655
5,592,689 A 1/1997 Matthews
5,845,335 A 12/1998 Twitty
5,978,962 A 11/1999 Hamowy

* cited by examiner

*Primary Examiner* — Tejash Patel
(74) *Attorney, Agent, or Firm* — John D. Tran

(57) ABSTRACT

The preferred embodiment of the inventive subject matter is a knee pad for assisting an infant in crawling. The knee pad comprises of a central portion having a concave inner surface and a convex outer surface, a means for holding the central portion on at least one knee of the infant, a character face incorporated into the convex outer surface of the central portion, and a sensor attached to at least one side of the means for holding the central portion. The sensor gets activated by a movement which simulates a sound that corresponds with the character face to assist in early recognition of particular sounds of animals. The means for holding the central portion in the knee of the infant can be a plurality of straps. At least one fastening means on the strap secures the means for holding the central portion at backside of the knee of the infant.

11 Claims, 6 Drawing Sheets

CHILD KNEE PAD

BACKGROUND OF THE INVENTION (1) Field of the Invention

The field of the invention is related to knee pads, in particular, to a knee pad which protects at least one knee of an infant and produce sounds that correspond with a character face on the knee pad.

BRIEF SUMMARY OF THE INVENTION (2) Description of Related Art

Babies usually crawl before they develop walking skills. Crawling is a cross-lateral movement and it activates development of the corpus callosum. Crawling strengthens infant's entire body, improves visual skills, offers opportunities for motor planning, improves endurance, body awareness, and provides vestibular stimulation and plenty of proprioceptive input to infant's joints. Infants tend to crawl over many different surfaces and textures which provide haptic stimulation. But while crawling, infants get subjected to injuries such as bruises, cuts, scrapes, and rug burn on their knees and feet. Currently, many sorts of knee pads are available in the way of knee protection for the infant. They often do not produce sounds that correspond to the character of the knee pad leaving their use far from ideal. U.S. Pat. No. 5,845,335 to Floleather Twitty on Dec. 8, 1998 discloses a new noise making garment which produces sound when noise pads are compressed and provide reinforced areas where wear is likely to occur. The inventive device includes a garment with a plurality of noise pads coupled to the garment. Each noise pad comprises a deformable bladder with a flexible wall that permits deformation of the bladder. The flexible wall defines an interior air chamber that holds air. A valve with a noise making device extends through the flexible wall of the bladder to permit the passage of air from the interior air chamber through the valve when the bladder is deformed. The noise making device creates an audible sound when air passes through the valve. Preferably, a noise pad is located at each knee region towards the front of the garment, at each elbow region towards the back of the garment, and at each sole region. Ideally, a reinforcement layer surrounds the outer surface of each noise pad that is located at the knee regions and at the elbow regions. Also ideally, each sole region further includes a nonslip rubber layer that surrounds the outer surface of the noise pad. As the noise making garment produces noise only when the wear is occurred on the garment, this garment is not suitable for crawling infants. Moreover, this invention will not give an audible notification of the location of the infant especially in situations where the infant is not in the direct line of sight of the care giver.

There are products out in the market in order to avoid above problems and to provide entertainment for infants while they are crawling. U.S. Pat. No. 5,592,689 to Matthews on Jan. 14, 1997 relates to a sound emitting knee pad apparatus. The sound emitting knee pad apparatus includes a pad assembly which emits a sound when the infant is crawling on the floor surface. A pad connector assembly connects the pad assembly to a knee of the person or to an outside surface of a knee-juxtaposed region of a garment worn by the person. The pad connector assembly includes a first connector assembly attached to an outside surface of a knee-juxtaposed region of a garment. A second connector assembly is attached to an outside surface of the pad assembly. The first connector assembly is a quantity of hook-or-loop connector material.

The second connector assembly is a quantity of complementary loop-or-hook connector material. The pad assembly may be comprised of a rubber material. Alternatively, the pad assembly may include an air chamber assembly which includes a plurality of resilient exterior walls which define an interior air chamber. A whistle assembly is supported by one of the resilient exterior walls. The whistle assembly provides an air communication path between the interior air chamber and air outside the interior air chamber. The pad connector assembly may include a strap assembly which includes a first end connected to a first side of the pad assembly and includes a second end connected to a second side of the pad assembly. The strap assembly is comprised of elastic resilient material. While the sound emitting knee pad apparatus provides entertainment for infants when the infant crawls by producing sounds, this apparatus do not incorporate a character face on a knee pad. Moreover, this invention does not have sensors that produce sound that corresponds with the character face on the knee pad.

Similarly, U.S. Pat. No. 5,978,962 (Hamowy) describes a knee, elbow or other body part protector includes a playful, fanciful or novelty feature, figure or object that is not related to safety integrated therewith. A protective portion of the protector and the figure or object are integrated into the protector so as to provide protection or safety while also lending enjoyment, satisfaction or entertainment. Such protectors are particularly attractive to young children to encourage the children to wear them. The integration into the protector of the protective portion and the figure or object can be one of relative location or one in which part or the entire protective portion forms part of the feature or object, which can be defined graphically, by surface ornamentation and/or by one or more three-dimensional objects. Other parts of the protector, e.g., straps or an elastic sleeve, may be integrated into the figure or object. The figure may be a teddy bear or other animal having a head, front and hind legs all of which are plush and a tummy formed by a protection portion integrated with the head and eyes. This invention incorporates a character face on the knee pad. But this prior art does not disclose a sensor that simulates the sound that corresponds to the character face on the knee pad. While many of the prior art knee pads provide a certain amount of protection to the user, each of these knee pads are quite limited since it is not designed to produce sounds that correspond to a character on the knee pad which serves as an educational/learning tool to assist in early recognition of particular sounds of animals. Furthermore, none of these traditional knee pads disclose a complete knee pad design and sensor function including sensing movement (crawling, jumping, walking, running etc.) and initiating a noise/sound which serves as an audible notification of the location of the infant especially in situations where the infant is not in the direct line of sight of the parent.

All referenced patents, applications and literatures are incorporated herein by reference to their entirety. Furthermore, where a definition or use of a term in a reference, which is incorporated by reference herein, is inconsistent or contrary to the definition of that term provided herein, the definition of that term provided herein applies and the definition of the term in the reference does not apply. The invention may seek to satisfy one or more of the above-mentioned desire. Although the preferred embodiment of the inventive subject matter may obviate one or more of the above-mentioned desires, it should be understood that some aspects of the invention might not necessarily obviate them.

In these respects, child knee pad with sensor according to the preferred embodiment of the inventive subject matter substantially departs from the conventional concepts and designs of the prior art, and so doing provides a child knee pad that is not anticipated, rendered obvious, suggested, or even implied by any of the prior art child knee pad, either alone or in combination thereof.

DETAILED SUMMARY OF THE INVENTION

In view of the foregoing disadvantages inherent in the known types of knee pads to be used by an infant and means now present in the prior art, the general purpose of the preferred embodiment of the inventive subject matter, which will be described subsequently in greater detail, is to provide a knee pad for assisting an infant in crawling.

Another object of the preferred embodiment of the inventive subject matter is to provide a protective knee pad;

Another object of the preferred embodiment of the inventive subject matter is to provide an inexpensive knee pad;

Another object of the preferred embodiment of the inventive subject matter is to provide a knee pad having a sensor that simulates a sound which provide an audible notification of the location of the infant to a parent especially in situations where the infant is not in the direct line of sight of the parent;

Another object of the preferred embodiment of the inventive subject matter is to provide a knee pad having a sensor that simulates the sound that corresponds with a character face on the knee pad;

To attain this, the preferred embodiment of the inventive subject matter in one embodiment generally comprises a central portion having a concave inner surface and a convex outer surface, a means for holding the central portion on at least one knee of the infant, a character face incorporated into the convex outer surface of the central portion, and a sensor attached to at least one side of the means for holding the central portion which gets activated by a movement and simulates a sound that corresponds with the character face to assist in early recognition of particular sounds of animals.

The means for holding the central portion on at least one knee of the infant can be a plurality of straps. Straps can be adjusted relative to each other in various ways, such as by a Velcro, snap button, hook and loop fasteners etc.

In typical use, the means for holding the central portion encircles the at least one knee of the infant and protects the knee of the infant. Moreover, the sensor in the kneepad simulates a sound that corresponds with the character face.

There has thus been outlined, rather broadly, the more important features of the invention in order that the detailed description thereof may be better understood, and in order that the present contribution to the art may be better appreciated. There are additional features of the invention that will be described hereinafter.

In this respect, before explaining at least one embodiment of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting. To accomplish the above and related objects, this invention may be embodied in the form illustrated in the accompanying drawings, attention being called to the fact, however, that the drawings are illustrative only, and that changes may be made in the specific construction illustrated.

BRIEF DESCRIPTION OF THE DRAWING(S)

Various other objects, features and attendant advantages of the preferred embodiment of the inventive subject matter will become fully appreciated as the same becomes better understood when considered in conjunction with the accompanying drawings, in which like reference characters designate the same or similar parts throughout the several views, and wherein.

DETAILED DESCRIPTION OF THE DRAWINGS

The invention and its various embodiments can now be better understood by turning to the following detailed description of the preferred embodiments, which are presented as illustrated examples of the invention defined in the claims. It is expressly understood that the invention as defined by the claims may be broader than the illustrated embodiments described below.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following claims. For example, notwithstanding the fact that the elements of a claim are set forth below in a certain combination, it must be expressly understood that the invention includes other combinations of fewer, more or different elements, which are disclosed herein even when not initially claimed in such combinations.

Figure 1:
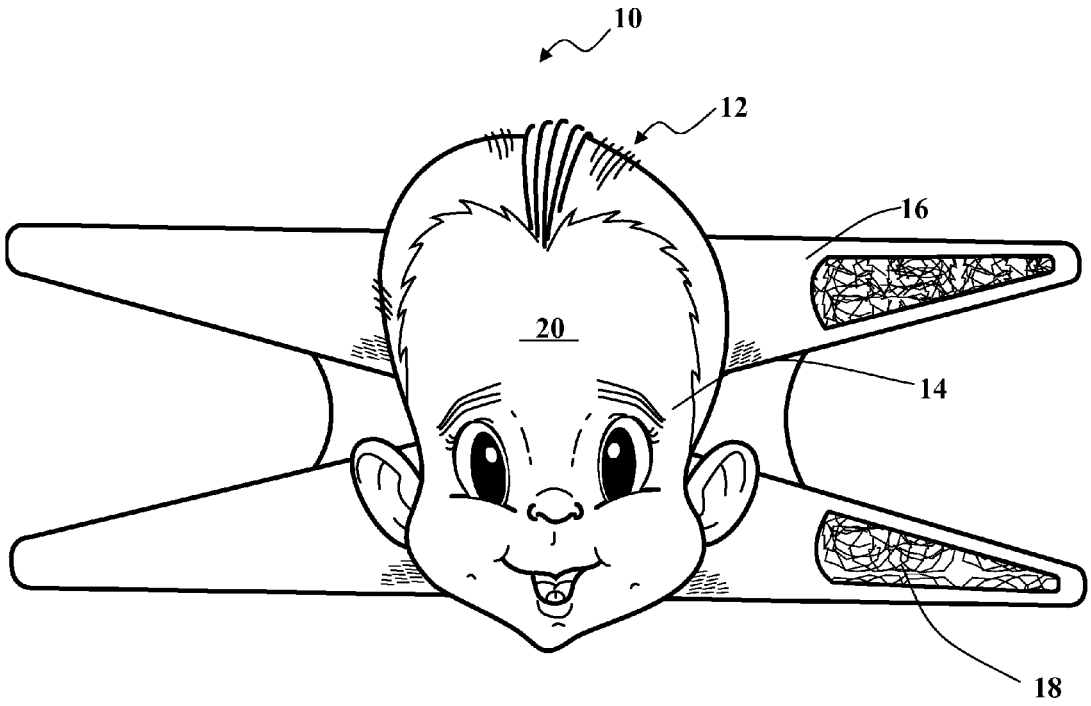
FIG. 1 is a front view of an embodiment of the inventive subject matter.

Referring now to the drawings, which are provided by way of illustration and example, and wherein like reference numerals designate like or corresponding elements among the several views, there is shown in FIG. 1, a child knee pad 10 for assisting an infant 62 in crawling, comprises a central portion 12 having a concave inner surface 52 and a convex outer surface 20. A means for holding the central portion 16 positions the knee pad 10 on at least one knee 64 of the infant 62. The central portion 12 can be a compressible padded or cushioned region that provides cushioning for the knee 64 of the infant 62. The cushioned region of the central portion 12 guard against wear and tear on clothing of the infant 62. Moreover, the knee pad 10 will not restrict blood circulation or movement of the infant 62. The knee pad 10 can be made from any pliable material. Further, the knee pad 10 prevents injuries such as bruises, cuts, scrapes, and rug burn as the central portion 12 provides cushioning for the knee 64 of the infant 62.

Figure 2:
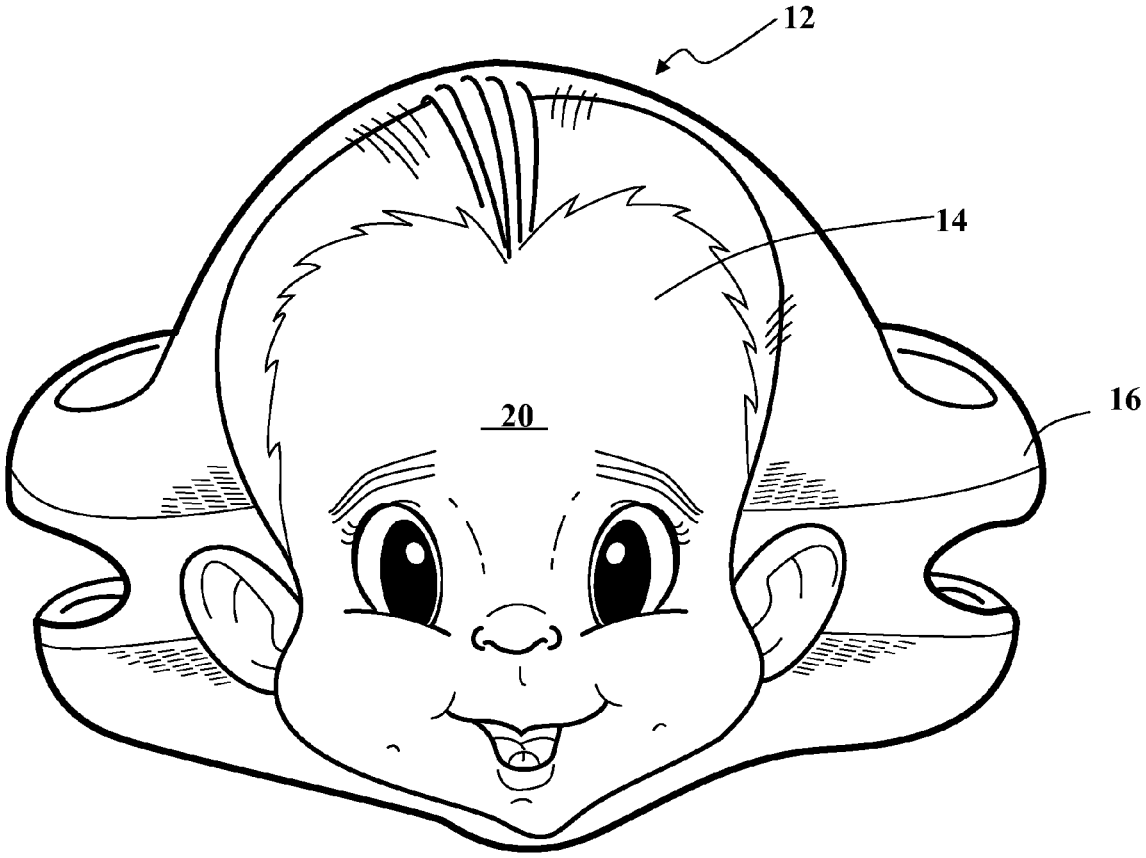
FIG. 2 is a front perspective view of an embodiment of the inventive subject matter showing a convex outer surface.
Figure 3:
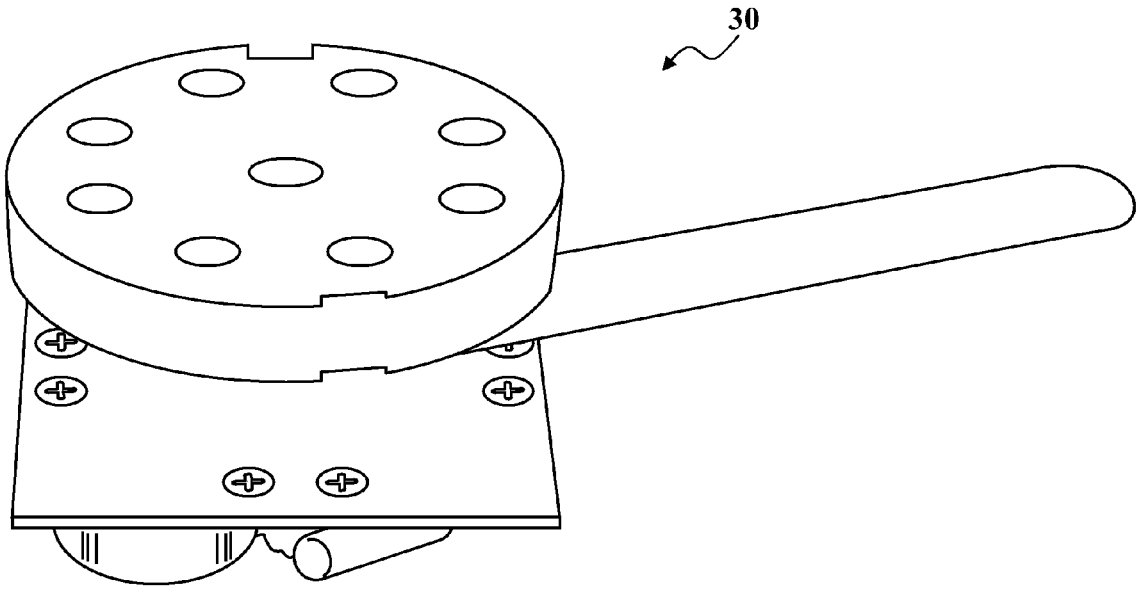
FIG. 3 is a perspective view of an embodiment of the sensor of the inventive subject matter.
Figure 4:
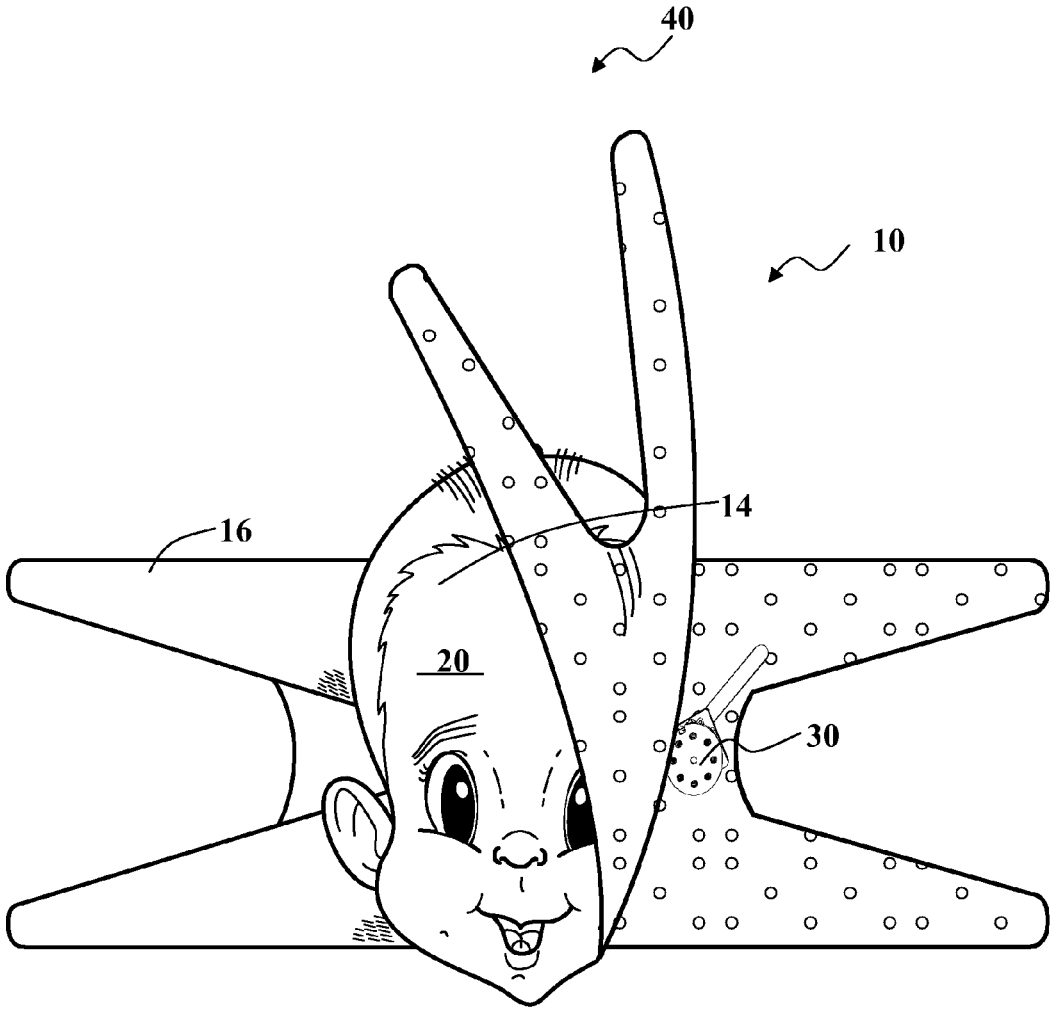
FIG. 4 is a perspective view of an embodiment of the inventive subject matter with a sensor attached to at least one side of a means for holding a central portion thereof.

Turning now to the embodiment of FIG. 2, shows a front perspective view of a knee pad 10 with a convex outer surface 20. A character face 14 is incorporated into the convex outer surface 20 of a central portion 12. The character face 14 can be made very colorful with cute zoo and farm animal's face for baby boys and baby girls. FIG. 3 is a perspective view of a sensor 30 that simulates a sound that corresponds with a character face 14 on a convex outer surface 20 of a knee pad 10. As in FIG. 4, a sensor 30 can be integrated on to at least one side of a means for holding a central portion 16 of a knee pad 10. In general, the sensor 30 can be integrated, incorporated or unified into different positions on the knee pad 10. In an embodiment, the sensor 30 is integrated on the front of the knee pad 10. The sensor can be triggered by a variety of signals such as movement of the infant or by pressure being applied to the sensor.

Figure 5:
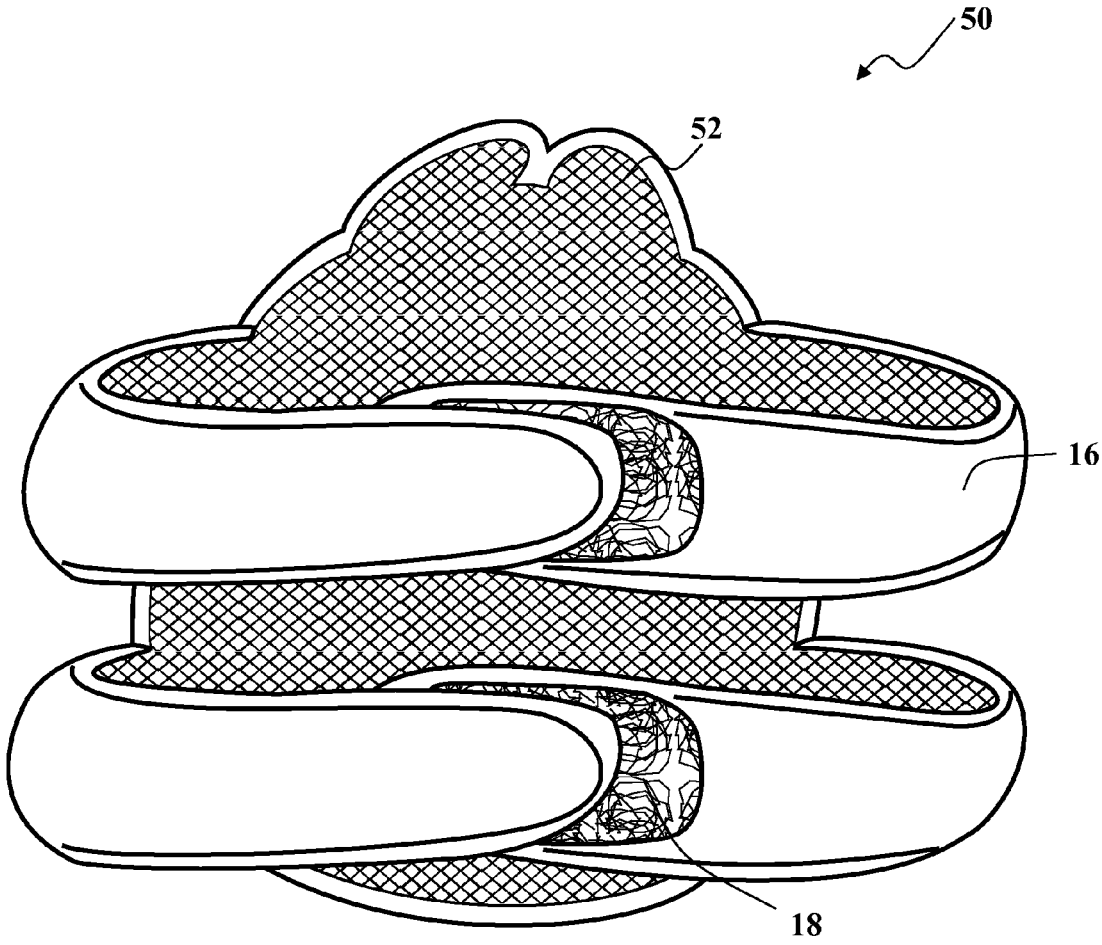
FIG. 5 is a rear perspective view of an embodiment of the inventive subject matter showing a concave inner surface.

As shown in FIG. 5, a knee pad 10 uses a means for holding the central portion 16 that encircles at least one knee 64 of an infant 62 to hold a concave inner surface 52 of a central portion 12. The means for holding the central portion 16 in the knee 64 of the infant 62 can be a plurality of straps. The plurality of straps include at least one fastening means 18 to secure the knee pad 10 in the desired location. Straps can be adjusted relative to each other in various ways, such as by a Velcro, snap button, hook and loop fasteners etc. However, any other suitable fastening means 18 can be used to hold the knee pad 10 comfortably around the knee 64 of the infant 62. The fastening means 18 secures the plurality of straps behind the knee 64 of the infant 62 and thus prevent the knee pad 10 from slipping.

Figure 6:
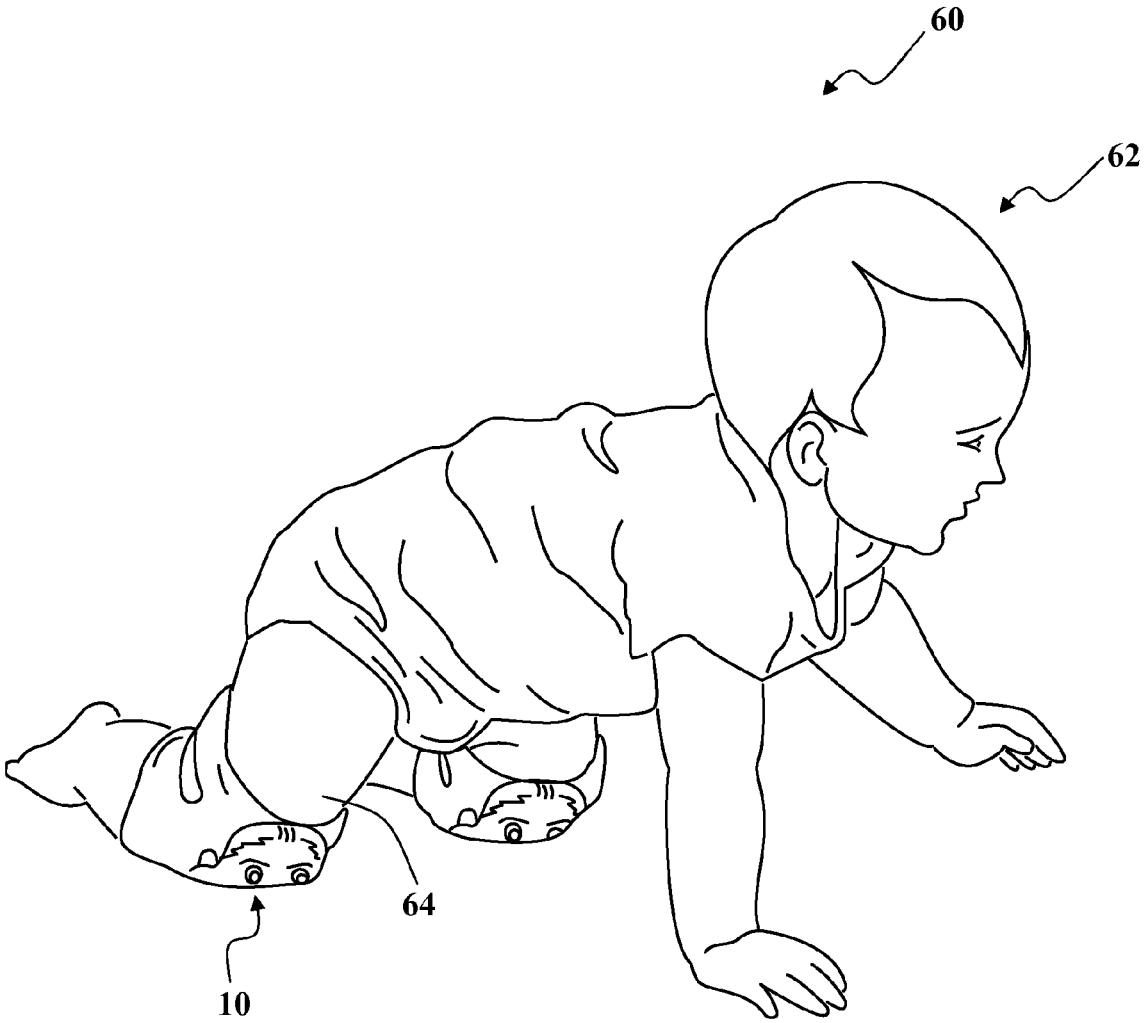
FIG. 6 is a perspective view of an embodiment of the inventive subject matter in typical use/

FIG. 6 illustrates a knee pad 10 in use by an infant 62. In use, the knee pad 10 is placed about a knee region 64 of the infant 62 and extends a means for holding the central portion 16 towards backside of the knee 64 of the infant 62. With the help of at least one fastening means 18, the means for holding the central portion 16 can be secured at backside of the knee 64 of the infant 62. When the infant 62 crawls on a surface, the knee pad 10 protects at least one knee 64 of the infant 62. Moreover, a sensor 30 in the knee pad 10 simulates a sound that corresponds with a character face 14 on a convex outer surface 20 and the sound that produced assists the infant 62 in early recognition of particular sounds of animals. Additionally, the sounds provide a parent the ability to have an audible notification of the location of the infant 62 especially in situations where the infant 62 is not in the direct line of sight of the parent.

Thus, specific embodiments and applications of the knee pad have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components or steps may be present, or utilized, or combined with other elements, components, or steps that are not expressly referenced. Where the specification claims refer to at least one of something selected from the group consisting of A, B, C . . . and N, the text should be interpreted as requiring only one element from the group, not A plus N, or B plus N, etc.

What is claimed is:

1. A knee pad for assisting an infant in crawling, the knee pad comprising:

a central portion having a concave inner surface and a convex outer surface;

a means for holding the central portion on at least one knee of the infant;

an animal face incorporated into the convex outer surface of the central portion; and a sensor attached to at least one side of the means for holding the central portion;

whereby the sensor gets activated by a movement and generates a sound of said animal to assist in early recognition of particular sounds of said animal.

2. The knee pad as recited in claim 1, wherein the knee pad can be made from any pliable material.

3. The knee pad as recited in claim 1, wherein the central portion can be a compressible padded region.

4. The knee pad as recited in claim 1, wherein the concave inner surface of the central portion is adapted to receive at least one knee of the infant.

5. The knee pad as recited in claim 1, wherein the means for holding the central portion in the knee of the infant can be a plurality of straps.

6. The knee pad as recited in claim 5, wherein the plurality of straps include at least one fastening means.

7. The knee pad as recited in claim 6, wherein the at least one fastening means is selected from a group consisting of a snap button, and hook and loop fasteners.

8. The knee pad as recited in claim 6, wherein the at least one fastening means secures the plurality of straps behind the knee of the infant.

9. A method of assisting in early childhood recognition of animal sounds by wearing a knee pad to at least one knee of an infant crawling over a surface, the method comprising:

a. providing the knee pad having a central portion and a means for holding the central portion in the knee of the infant, wherein the knee pad has an animal face disposed on a convex outer surface of the knee pad, and wherein the knee pad has an sensor attached to at least one side of the means for holding the central portion that generates a sound of said animal;

b. placing the knee pad about the knee region of the infant;

c. extending the means for holding the central portion towards backside of the knee of the infant;

d. securing the means for holding the central portion at the backside of the knee of the infant by at least one fastening means.

10. The method as recited in claim 9, wherein the central portion can be a compressible padded region.

11. The method as recited in claim 9, wherein the at least one fastening means is selected from a group consisting of a a hook and loop material, and snap button.

* * * * *